US005725142A

United States Patent [19]

Hamada

[11] Patent Number: 5,725,142

[45] Date of Patent: Mar. 10, 1998

[54] PNEUMATIC FASTENER DRIVING TOOL HAVING AIR EXHAUST ARRANGEMENT

[75] Inventor: Masao Hamada, Hitachinaka, Japan

[73] Assignee: Hitachi Koki Co., Ltd., Tokyo, Japan

[21] Appl. No.: 703,891

[22] Filed: Aug. 27, 1996

[30] Foreign Application Priority Data

Sep. 14, 1995 [JP] Japan ..... 7-236542

[51] Int. Cl.[6] ..... B25C 1/04

[52] U.S. Cl. ..... 227/130

[58] Field of Search ..... 227/130, 8, 10

[56] References Cited

U.S. PATENT DOCUMENTS

| | | | |
|---|---|---|---|
| 4,858,812 | 8/1989 | Fealey | 227/130 |
| 5,110,030 | 5/1992 | Tanji | 227/130 |
| 5,131,579 | 7/1992 | Okushima et al. | 227/130 |
| 5,259,465 | 11/1993 | Mukoyama et al. | 227/130 |
| 5,437,339 | 8/1995 | Tanaka | 227/130 |
| 5,558,264 | 9/1996 | Weinstein | 227/130 |

*Primary Examiner*—Scott A. Smith

*Attorney, Agent, or Firm*—Sughrue, Mion, Zinn, Macpeak & Seas, PLLC

[57] ABSTRACT

A pneumatic fastener driving tool having a cover member which covers an exhaust port of a body portion. The body portion has a top wall, and a cover member is engagingly fixed to an upper portion of the body portion. The cover member and the upper portion of the body portion define an exhaust air passage, and the cover member has an exhaust opening in communication with the exhaust passage. The cover member is formed of an elastic material and has a top wall where a through hole is formed. Normally, a lower surface of the cover member is in surface contact with an upper surface of the top wall of the body portion. If the cover member is thermally deformed, the lower surface of the cover member is separated from the upper surface of the top wall of the body portion, and exhaust air may be leaked into the space. The leaked exhaust air is discharged outside through the through hole.

5 Claims, 7 Drawing Sheets

PNEUMATIC FASTENER DRIVING TOOL HAVING AIR EXHAUST ARRANGEMENT

BACKGROUND OF THE INVENTION

The present invention relates to a pneumatic fastener driving tool for ramming down or driving fasteners such as nails etc. into an intended location, and more particularly, to the type thereof having an improved air exhaust arrangement.

A pneumatic fastener driving tool urges an internal drive piston downwardly through a drive source such as a compressed air for driving a nail etc. into a wall or other intended location. The drive piston is reciprocally movable, and therefore, the compressed air applied to an upper portion of the drive piston must be discharged to an atmosphere during return stroke of the piston. To this effect, an exhaust port is formed at an upper portion of the driving tool for allowing the compressed air to be discharged outside.

One example of a conventional pneumatic fastener driving tool is shown in FIGS. 5 through 10. As best shown in FIG. 5, the driving tool generally includes a body portion 7, a magazine 14, and nail feeding portion 15. In the body portion 7, a cylinder 10 is provided in which a drive piston 8A is slidably disposed. Further, a drive bit 8B is disposed integrally with the drive piston 8A for ramming or driving the fastener. A head valve 12 is disposed above the cylinder 10. The head valve 12 has an upper sleeve portion 12A in which a compression spring 6 is disposed for normally urging the head valve 12 downwardly so as to maintain air tight arrangement between the head valve 12 and an upper edge of the cylinder 10. A piston chamber 2 is defined within the cylinder 10 and between the head valve 12 and the drive piston 8A.

The upper sleeve portion 12A has a central bore in fluid communication with the piston chamber 2. Further, a compressed air chamber 9 is defined in the body portion 7 and outside the cylinder 10. Because compressed air is applied into the compressed air chamber 9, the compressed air pressure urges the head valve 12 upwardly against the biasing force of the compression spring 6.

At a lower portion of the body portion 7, a fastener injection passage 11 is provided through which the fastener and the drive bit 8B pass. The magazine 14 is provided at the lower portion of the body portion 7 for accommodating therein the fasteners. The nail feeding portion 15 is provided for successively feeding the nails from the magazine 14 to the fastener injection passage 11. Further, a push lever 17 is movably disposed around a nose portion 18. A lower end of the push lever 17 is adapted to be pressed against a workpiece.

The body portion 7 has an upper wall portion 7A positioned above the head valve 12, and a head valve chamber 13 is defined between the upper wall portion 7A of the body portion 7 and the head valve 12. The compressed air is applicable to the head valve chamber 13. Further, the upper wall portion 7A of the body portion 7 is formed with an exhaust port 5 for discharging compressed air in the piston chamber 2 to the atmosphere through the upper sleeve portion 12A after driving operation.

A cover member 101 is attached to the body portion 7 at a position above the exhaust port 5 for covering the exhaust port 5. More specifically, the cover member 101 is formed of elastic or resilient material such as a rubber and plastic material. The upper wall portion 7A of the body portion 7 has an engaging groove 22 with which an engaging projection 102 of the cover member 101 is resiliently engaged.

This engagement is described in a commonly assigned U.S. Pat. No. 5,110,030.

An air discharge passage 3 is provided in the inside or lower surface of the cover member 101 and around outer peripheral surface of the upper wall portion 7A of the body portion 7. A sealing portion 20 is provided at the boundary between a circular top wall 7B of the upper wall portion 7A and the lower surface of the cover member 101 so as to prevent the discharged compressed air from being entered into a gap between the top wall 7B and the lower surface of the cover member 101. To this effect, the lower surface of the cover member 101 is formed with a circular recess with which the circular top wall 7B of the body portion 7 is engaged. The cover member 101 has a side wall formed with a notched portion 21 in communication with the air discharge passage 3. As shown in FIG. 10, the cover member 101 can be rotatable so as to change the discharging direction of the compressed air.

With this arrangement, if the tip end of the push lever 17 is pressed against the workpiece, the push lever 17 is upwardly moved, and by pressing the trigger 16, compressed air in the head valve chamber 13 is discharged, so that the head valve 12 is moved upwardly because of the applied compressed air pressure in the compressed air chamber 9 as shown in FIG. 6, and the head valve 12 is separated from the upper edge of the cylinder 10. Accordingly, the compressed air can be introduced into the piston chamber 2 to pneumatically move the drive piston 8A downwardly. In this case, the upper end of the upper sleeve portion 12A is seated against the top wall 7B of the body portion 7. Therefore, the exhaust port 5 is closed by the upper sleeve portion 12A, so that the compressed air in the piston chamber 2 cannot be discharged outside.

The drive piston 8A is rapidly urged downwardly by the compressed air, so that the fastener is driven downwardly into the workpiece by way of the drive bit 8B as shown in FIG. 7. Then after releasing the trigger 16, compressed air is introduced into the head valve chamber 13, so that the head valve 12 is moved downwardly in co-operation with the compression spring 6, and finally the head valve 12 is seated on the upper edge of the cylinder 10 to block fluid communication between the compressed air chamber 9 and the piston chamber 2 as shown in FIG. 8. Simultaneously, the upper edge of the upper sleeve portion 12A is moved away from the upper wall 7A of the body portion 7, so that the exhaust port 5 is brought into fluid communication with the piston chamber 2 through the bore of the upper sleeve portion 12A. Accordingly, the piston chamber 2 is brought into fluid communication with the atmosphere through the exhaust passage 3 and the exhaust opening 21.

Since the cover member 101 is formed of the elastic or resilient material such as rubber and plastic material, the cover member 101 may be softened if the cover member 101 is exposed to high temperature. Therefore, the cover member 101 may be easily deformed due to the applied compressed air pressure. Upon deformation of the cover member 101, the lower surface of the cover member 101 is separated from the upper surface of the top wall 7B of the body portion 7. Accordingly the seal portion 20 looses its performance and exhaust air may be entered into the space between the lower surface of the cover member 101 and the upper surface of the top wall 7B as shown in FIG. 9. If excessive amount of exhaust air is entered into the space, the cover member 101 is further urged upwardly and may be released from the body portion 7. That is, the engaging projection 102 may be disengaged from the engaging groove 22.

In order to avoid this problem, a screw may be used to threadingly fix the cover member 101 to the upper wall 7A of the body portion 7. Alternatively, another biasing component may be disposed above the cover member 101 to urge the cover member 101 downwardly. However, according to these methods, increased number of components must be used, to lower productivity of the fastener driving tool.

SUMMARY OF THE INVENTION

It is therefore, an object of the present invention to provide an improved cover or cap member having an exhaust passage for use in a pneumatic fastener driving tool, the cover member being capable of avoiding its detachment from a body portion of the driving tool due to exhaust air passing through the exhaust passage without increasing mechanical parts or components.

This and other objects of the present invention will be attained by a pneumatic fastener driving tool including a body portion, a drive piston, and an improved cover member. The body portion defines therein a compressed air chamber in which compressed air is accumulatable. A compressed air exhaust port is provided at an upper portion of the body portion. the body portion has a top wall having an upper surface. The drive piston is reciprocally movable in the body portion for driving or ramming a driven member in one direction. The compressed air in the compressed air chamber is applicable to the drive piston for its movement in the one direction. The cover member is provided over the top wall of the body portion for covering the exhaust port. The cover member is formed of an elastic or resilient material and has an exhaust passage and an exhaust opening through which exhaust air through the exhaust port is discharged to an atmosphere. The cover member has a lower surface normally in surface contact with the upper surface of the top wall. The cover member has a top wall formed with a through hole for discharging the exhaust air which may be accidentally entered into a space defined between the lower surface of the top wall of the cover member and the upper surface of the top wall of the body portion.

DETAILED DESCRIPTION OF THE PREFERRED EMBODIMENTS

Figure 1:
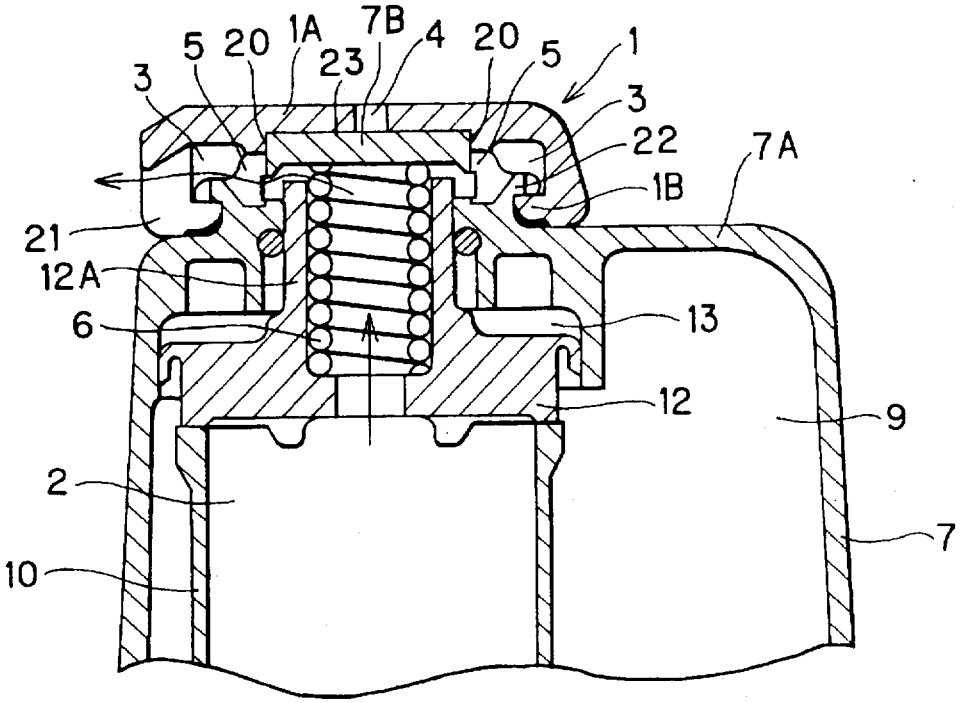
FIG. 1 is a cross-sectional view showing a head portion of a pneumatic fastener driving tool according to one embodiment of the present invention in which flow of exhaust air is shown in a state where fastener driving has finished.

A pneumatic fastener driving tool having an improved cover member according to a first embodiment of this invention will be described with reference to FIGS. 1 through 4, wherein like parts and components are designated by the same reference numerals as those shown in FIGS. 5 through 10 to avoid duplicating description.

A cover member 1 of the present embodiment is formed of a elastic or resilient material such as thermoplastic polyurethane elastomer, polyester base elastomer, styrene base elastomer, nitrile rubber, and a relatively soft elastic material having rubber hardness ranging from Hs 85 to Hs 100. The cover member 1 is formed with an exhaust air passage 3 and has a notched portion 21 serving as an exhaust opening. The cover member 1 has a side wall portion in which an engaging projection 1B is provided. The engaging projection 1B is engaged with an engaging groove 22 similar to the conventional device.

Figure 3:
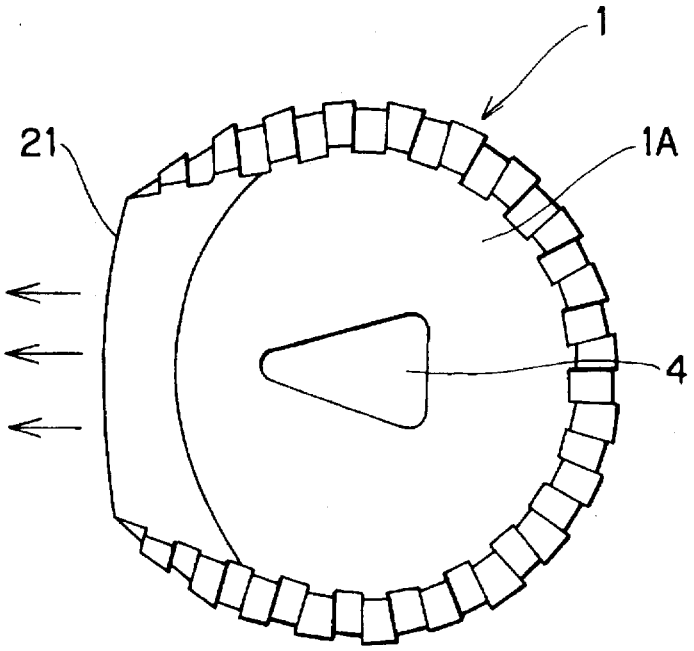
FIG. 3 is a plan view showing a cover member according to the embodiment.
Figure 4:
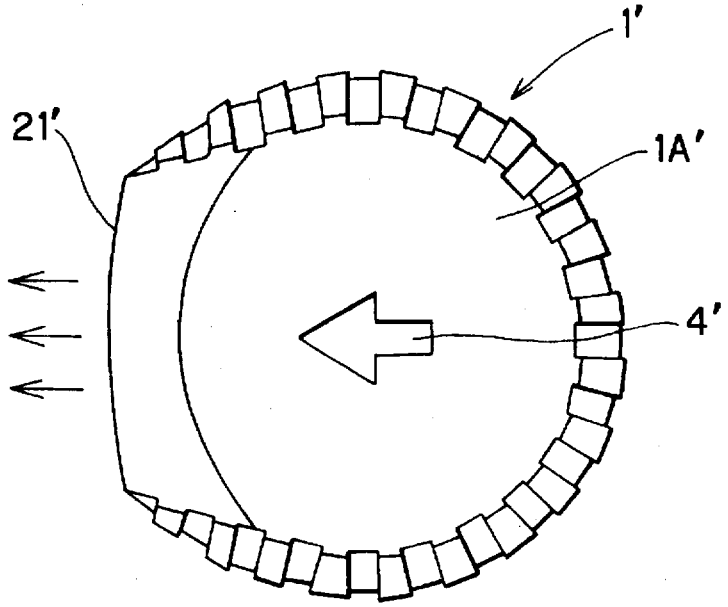
FIG. 4 is a plan view showing a cover member according to a modified embodiment.
Figure 5:
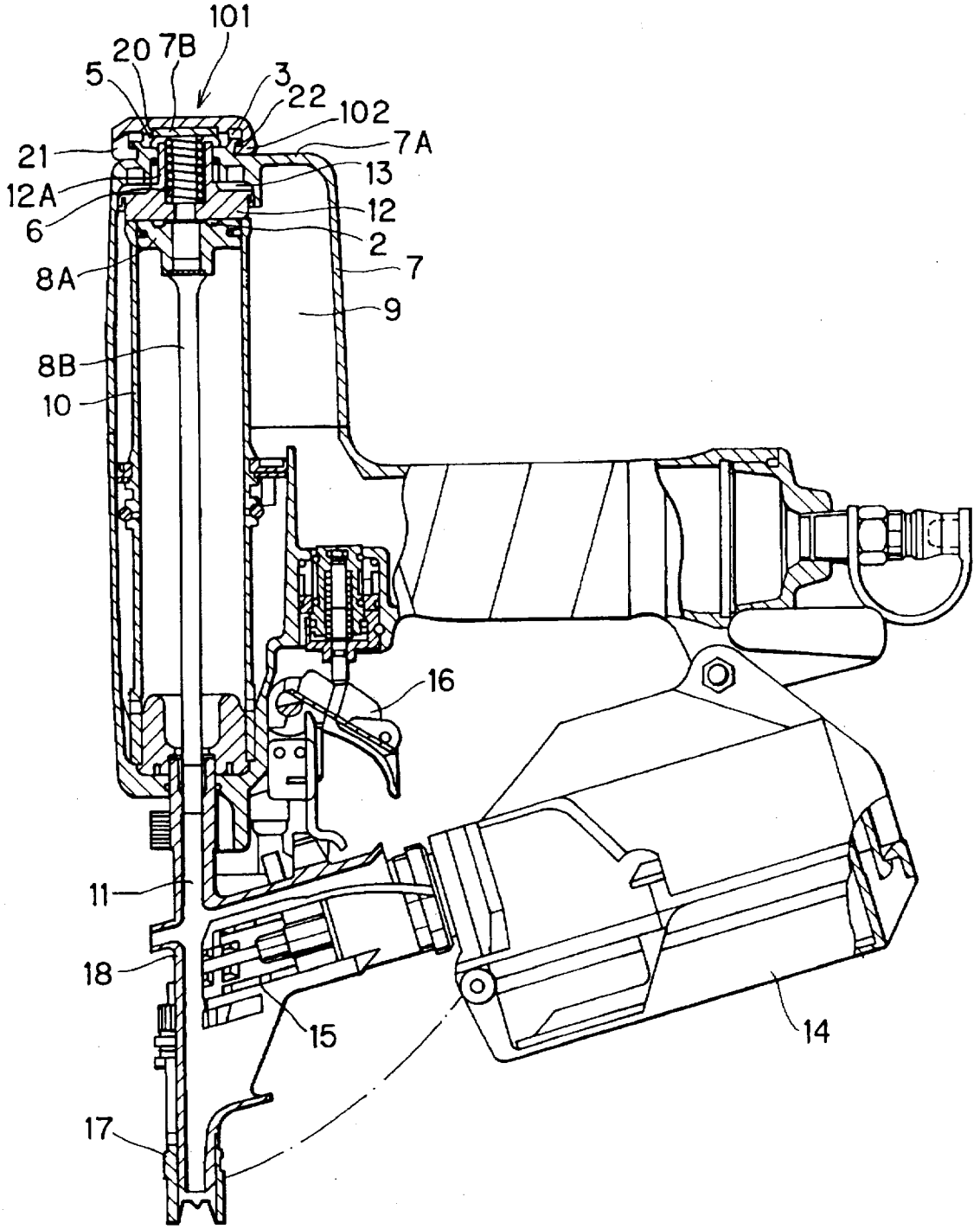
FIG. 5 PRIOR ART
FIG. 5 is a cross-sectional view showing a conventional pneumatic fastener driving tool.
Figure 6:
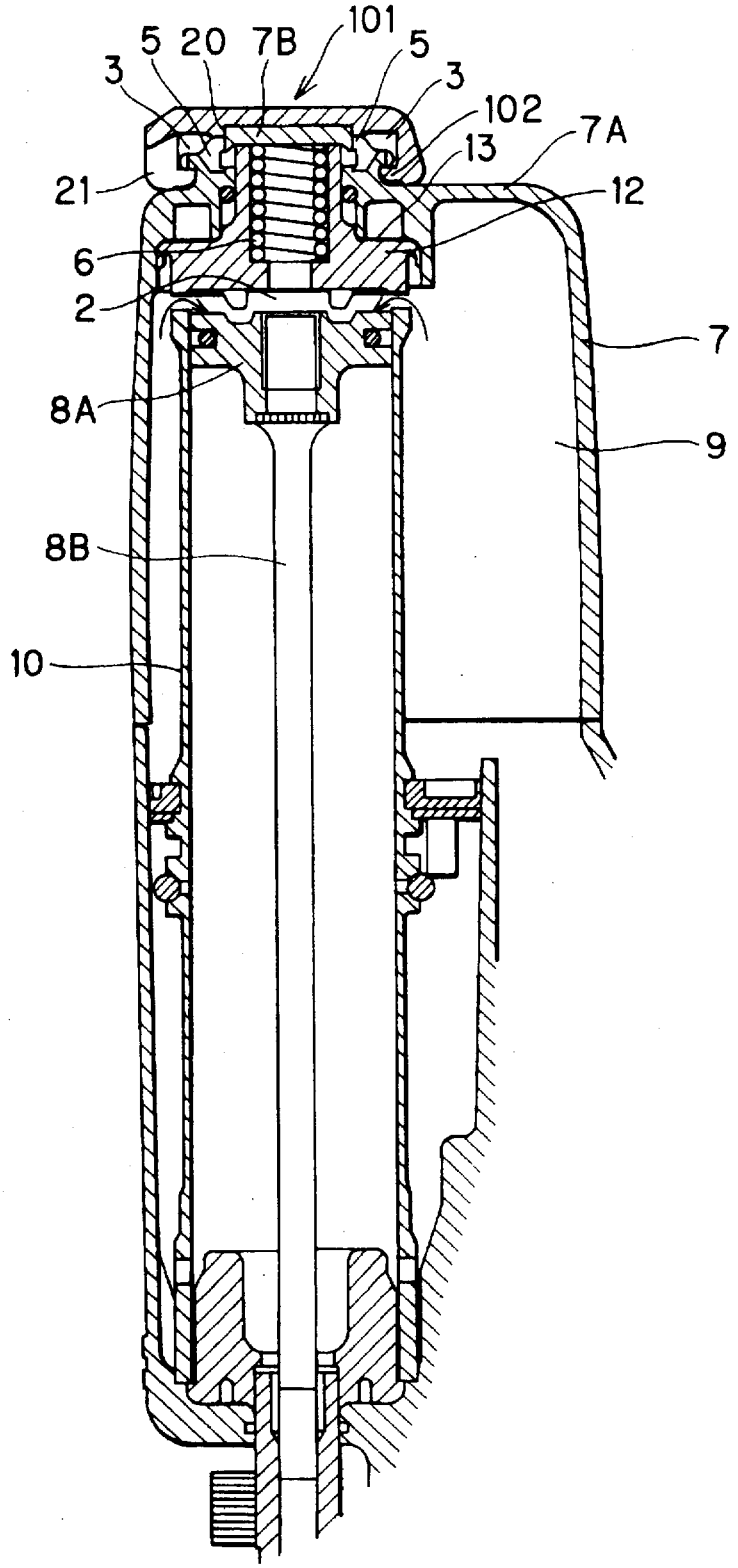
FIG. 6 PRIOR ART
FIG. 6 is a cross-sectional view showing the conventional driving tool and showing an initial faster driving state.
Figure 7:
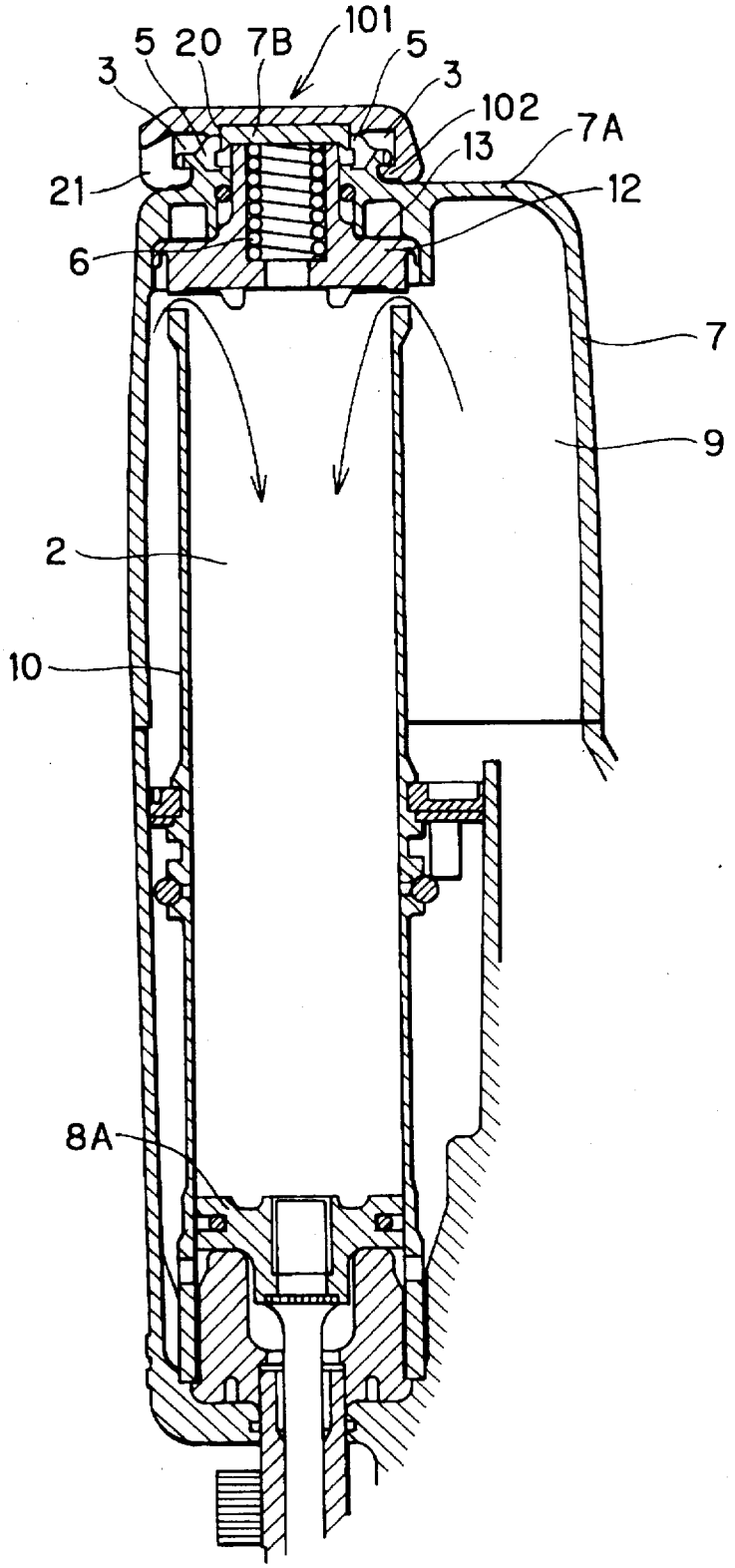
FIG. 7 PRIOR ART
FIG. 7 is a cross-sectional view showing the conventional driving tool and showing faster driving state.
Figure 8:
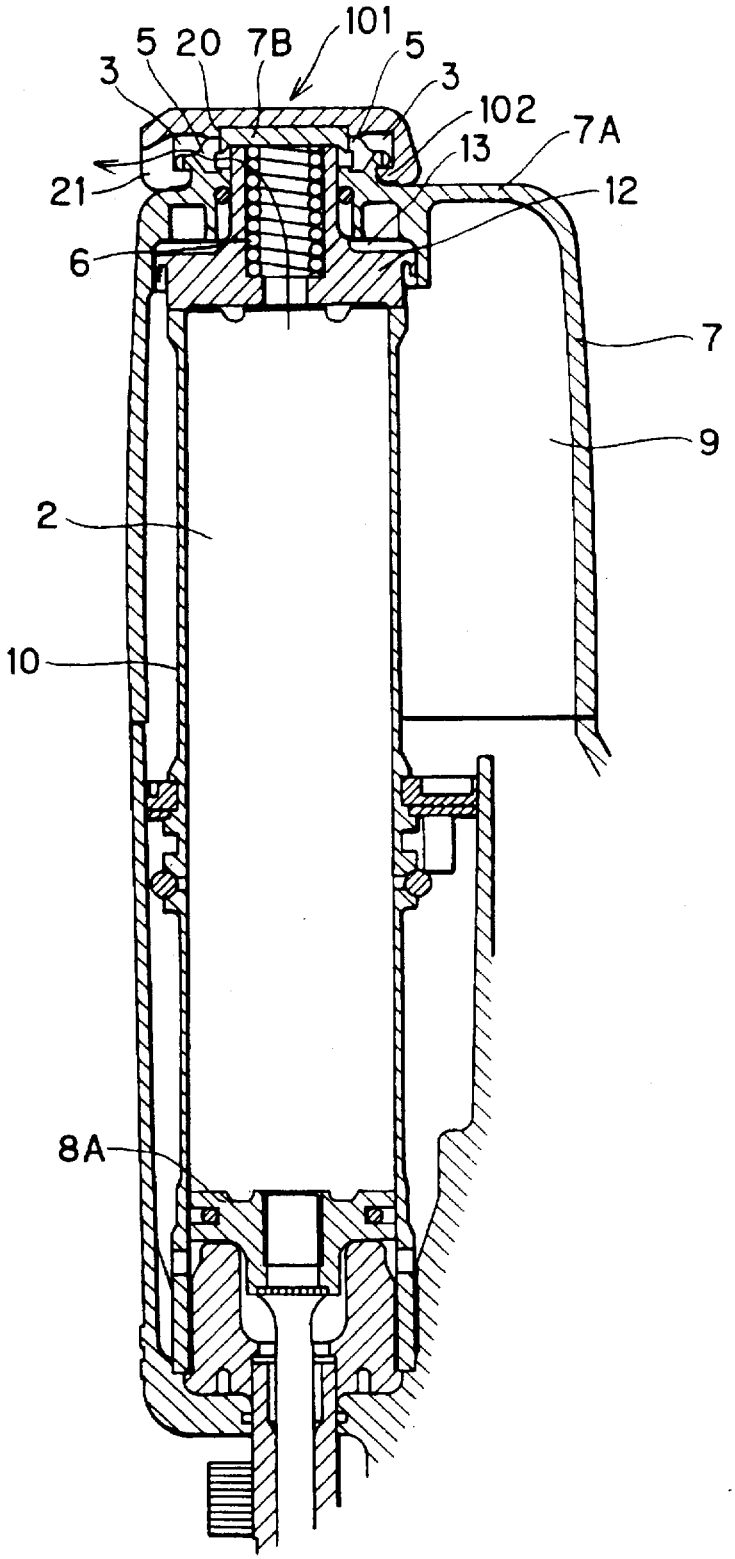
FIG. 8 PRIOR ART
FIG. 8 is a cross-sectional view showing the conventional driving tool and showing a state where faster driving has finished.
Figure 9:
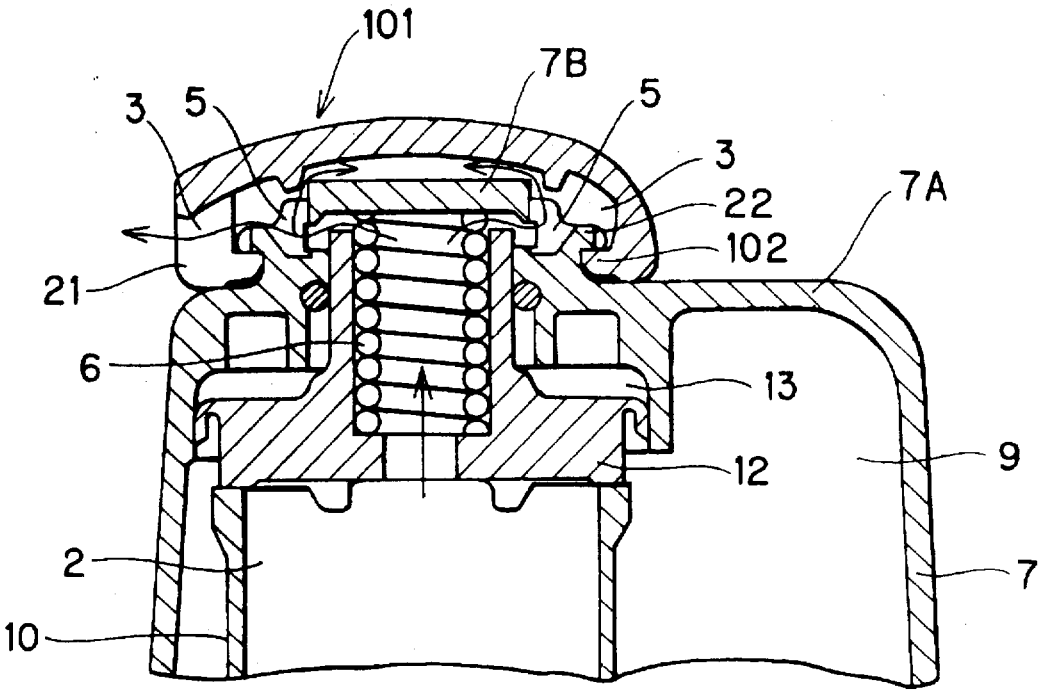
FIG. 9 PRIOR ART
FIG. 9 is a cross-sectional view showing an essential portion of the conventional driving tool and showing deformed state of a conventional cover member.
Figure 10:
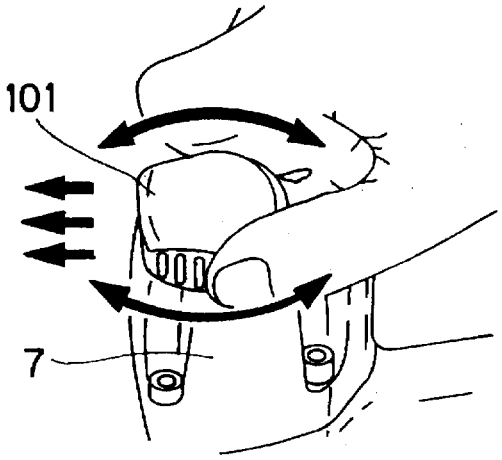
FIG. 10 PRIOR ART
FIG. 10 is a partial perspective view showing angular rotation of the conventional cover member.

The cover member 1 has a top wall portion 1A in which a through hole 4 is formed. The through hole 4 extends through a thickness of the top wall portion 1A, so that an inner open end of the through hole 4 is seated on the upper surface of the top wall 7B of the body portion 7. The through hole 4 has a triangular shape as shown in FIG. 3 so as to indicate exhaust air discharging direction through the exhaust opening 21. That is, an acute apex of the triangle indicates the air discharging direction. Alternatively, as shown in FIG. 4, a top wall 1A' of the cover member 1' has a through hole 4' having an arrow shape. The direction of the arrow indicates the air discharging direction from the discharge opening 21'.

Figure 2:
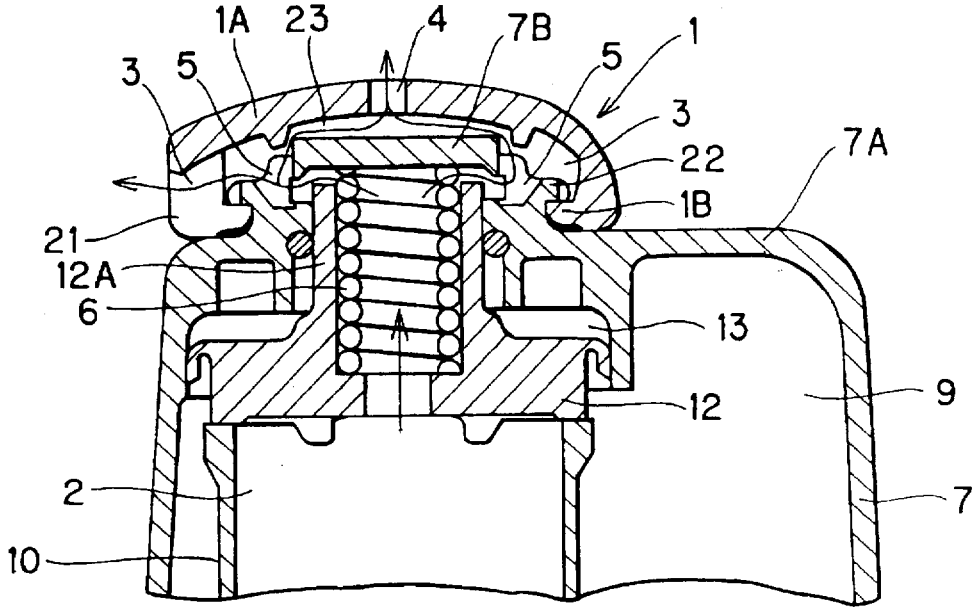
FIG. 2 is a cross-sectional view showing the head portion of the pneumatic fastener driving tool according to the embodiment in which flow of exhaust air is shown in a state where fastener driving has finished through the employment of the driving tool under the high temperature.

When the fastener driving operation by the downward travel of the drive piston is finished, the compressed air in the piston chamber 2 can be discharged into the air discharge passage 3 as described above. In this case, if the driving tool is used under the high temperature, the cover member 1 may be exposed to high temperature and may be softened and therefore easily deformable. Accordingly, the compressed air may be leaked into the space between the upper surface of the top wall 7B and the lower surface of the cover member 1 as shown in FIG. 2 through the loosened sealing portion 20. However, the entered compressed air can be easily discharged outside through the through hole 4 or 4'. Accordingly, no upwardly urging force is applied to the top wall 1A of the cover member 1. Consequently, the engagement between the engaging groove 22 and the engaging projection 1B can be maintained. In other words, release of the cover member 1 from the body portion 7 can be avoided.

Thus, in the depicted embodiment, unwanted separation of the cover member 1 from the body portion 7 is avoidable, and further, air discharging direction can be easily recognized by the shape of the through hole 4 or 4'.

While the invention has been described in detail and with reference to specific embodiment thereof, it would be apparent to those skilled in the art that various changes and modifications may be made therein without departing from the spirit and scope of the invention.

What is claimed is:

1. A pneumatic fastener driving tool comprising:

a body portion defining therein a compressed air chamber in which compressed air is accumulatable, a compressed air exhaust port being provided at an upper portion of the body portion, the body portion having a top wall having an upper surface;

a drive piston reciprocally movable in the body portion for driving or ramming a driven member in one direction, the compressed air in the compressed air chamber being applicable to the drive piston for its movement in the one direction;

and a cover member provided over the top wall of the body portion for covering the exhaust port, the cover member being formed of an elastic or resilient material and having an exhaust passage and an exhaust opening through which exhaust air through the exhaust port is discharged to an atmosphere, the cover member having a lower surface normally in surface contact with the upper surface of the top wall;

and the improvement comprising:

the cover member having a top wall formed with a through hole for discharging the exhaust air which may be accidentally entered into a space defined between the lower surface of the top wall of the cover member and the upper surface of the top wall of the body portion.

2. The pneumatic fastener driving tool as claimed in claim 1, wherein the cover member is angularly rotatable with respect to the body portion, and wherein the through hole has a triangular shape, an apex of the triangular through hole indicating a position of the exhaust opening for acknowledging a discharging direction of the exhaust air.

3. The pneumatic fastener driving tool as claimed in claim 2, wherein the cover member has a side wall portion at which an engagement projection is provided, the exhaust opening being formed at the side wall, and the upper portion of the body portion has an engaging groove engageable with the engaging projection for rotatably fixing the cover member to the body portion.

4. The pneumatic fastener driving tool as claimed in claim 1, wherein the cover member is angularly rotatable with respect to the body portion;

and wherein the through hole has an arrow shape, a direction of the arrow indicating a position of the exhaust opening for acknowledging a discharging direction of the exhaust air.

5. The pneumatic fastener driving tool as claimed in claim 4, wherein the cover member has a side wall portion at which an engagement projection is provided, the exhaust opening being formed at the side wall, and the upper portion of the body portion has an engaging groove engageable with the engaging projection for rotatably fixing the cover member to the body portion.

* * * * *